United States Patent [19]

Ricles

[11] Patent Number: 5,024,277

[45] Date of Patent: Jun. 18, 1991

[54] RUNNING TOOL FOR USE IN WELL BORES

[75] Inventor: Thomas D. Ricles, Kingwood, Tex.

[73] Assignee: Dresser Industries, Inc., Dallas, Tex.

[21] Appl. No.: 475,689

[22] Filed: Feb. 6, 1990

[51] Int. Cl.[5] ..... E21B 31/18

[52] U.S. Cl. ..... 166/381; 166/64; 166/385; 294/86.17; 294/86.32; 294/86.33

[58] Field of Search ..... 166/64, 385, 98, 301, 166/381, 125; 294/86.17, 86.18, 86.26, 86.28, 86.29, 86.32, 86.33

[56] References Cited

U.S. PATENT DOCUMENTS

| | | | |
|---|---|---|---|
| 3,950,021 | 4/1976 | Goldschild et al. | 294/86.29 X |
| 4,004,835 | 1/1977 | Taylor | 294/86.29 |
| 4,061,389 | 12/1977 | Keller et al. | 294/86.29 X |
| 4,796,706 | 1/1989 | Townsend et al. | 166/387 X |

*Primary Examiner*—Stephen J. Novosad
*Attorney, Agent, or Firm*—Roy L. Van Winkle

[57] ABSTRACT

A running tool and method for the use thereof in locating apparatus in a well bore includes an elongated hollow tool body and outer sleeve encircling the body; a mandrel disposed within the body and sleeve and carrying a collet on the lower end thereof which, in the running position of the tool, is enclosed within the sleeve; and a sealed chamber having a substantially incompressible fluid therein which is metered through a flange located on a tool mandrel to control the time required to move the mandrel between the running and release positions, thus controlling the force and time required for actuation of the tool to avoid inadvertent release of the well apparatus being lowered into the well bore.

23 Claims, 2 Drawing Sheets

FIG. 1
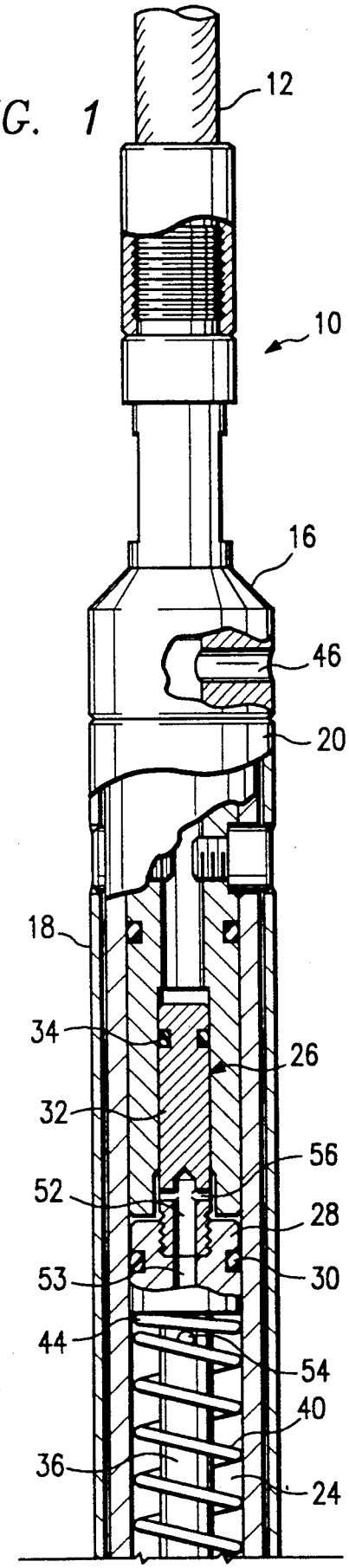
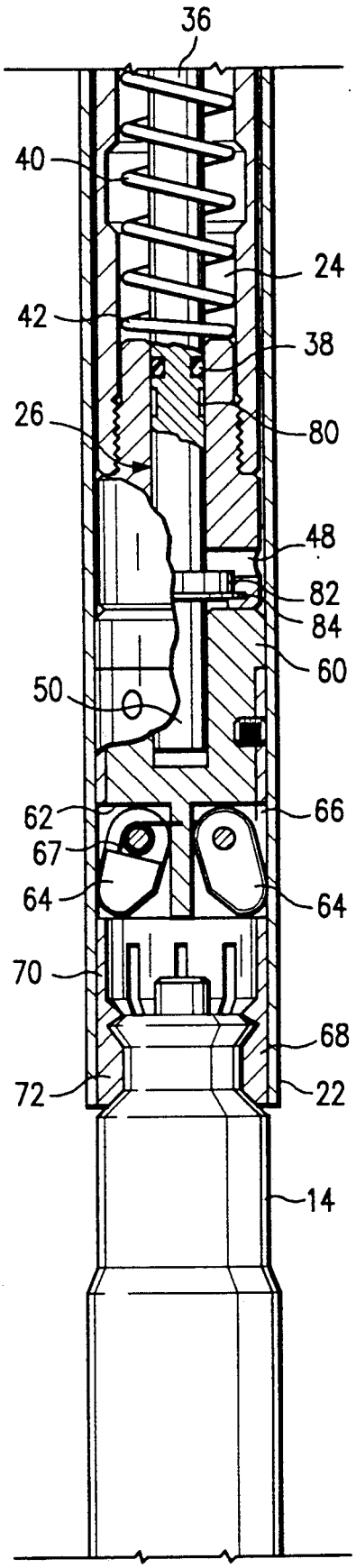
FIG. 2

RUNNING TOOL FOR USE IN WELL BORES

TECHNICAL FIELD OF THE INVENTION

This invention relates generally to running tools for positioning a releasable well apparatus in a well bore. More particularly, but not by way of limitation, this invention relates to a wire line running tool useful in setting well apparatus in a well bore, releasing the apparatus and withdrawing the running tool and providing the running tool with stop members for preventing the lowering of the running tool in the well bore after the well apparatus has been released therefrom.

BACKGROUND OF THE INVENTION

Running tools have been utilized in the oil industry for many years for the purpose of positioning well apparatus such as mechanical, hydraulic, electric and/or explosive devices in well bores. Many such apparatus are locked into a position in a well bore by means of a particular configuration of grooves or "profile" formed in the tubing or well bore wall into which a latch device on the apparatus lands.

Such tools have, in the past, been successful in the positioning of the well bore apparatus in the desired position due to the use of the profile. However, problems have occurred when tight spots in the tubing or well bore were encountered during lowering of the apparatus. Also, problems have occurred as a result of the running tool being dropped in the well bore and falling into the released well apparatus. The problem may be particularly acute when the well apparatus is a firing mechanism for a perforating gun or the like.

An example of the difficulties encountered in lowering the well apparatus into the well bore occurs when the apparatus becomes stuck in the well bore. When the apparatus sticks, it is usually necessary to work the apparatus in an effort to get the apparatus through the tight spot. Such working usually consists of applying a tensile force to the running tool and well apparatus which is attached thereto. Occasionally, such tensile force exceeds the force necessary to actuate the running tool and, consequently, the well apparatus is released prematurely.

Most of the running tools constructed heretofore have utilized some form of shear device holding the parts of the running tool in the running position. The shear devices are usually parted by applying a tensile force to the running tool that will exert a force thereon sufficient to cause failure of the shear device.

Also, such running tools have not, insofar as is known, incorporated means for preventing the running tool from being inadvertently dropped into the well bore in the event that the running tool becomes disengaged from the wire line or tubing used to move the running tool through the well bore. As mentioned before, this may cause premature firing of a perforating gun or other charge, and could result in malfunctioning of whatever type of well apparatus was previously positioned in the well bore.

An object of this invention is to provide a running tool for positioning well apparatus in a well bore that can be manipulated with safety in the event that the well apparatus becomes stuck, that utilizes no shear devices, and that can be moved only upwardly in the well bore after the well apparatus has been released therefrom.

SUMMARY OF THE INVENTION

In one aspect, this invention provides a running tool for use in locating releasable apparatus in a well bore that comprises: an elongated hollow tool body; a mandrel that is slidingly disposed in the tool body and moveable therein between a running position and a release position; an outer sleeve that encircles the body and has a first end that extends past one end of the body; a resilient collet member carried by the mandrel and disposed within the first end of the sleeve when the mandrel is in the running position and outside the sleeve when the mandrel is in the release position; a sealed chamber of fixed volume in the body; a substantially incompressible fluid filling the chamber; a flange on the mandrel located in the chamber with a seal in sliding and sealing engagement with the body; and a metering passageway in the mandrel providing restricted fluid flow from one side of the seal to the other as the mandrel moves therein, thereby determining the time required to move the mandrel between the running and release positions.

In another aspect, this invention contemplates a method for positioning apparatus in a well bore that comprises the steps of: extending a running tool, with the apparatus releasably connected thereto, to the desired location in the well bore; exerting a substantially constant tensile force on the tool for causing relative movement between a mandrel and tool body to release the apparatus; delaying the relative movement between the mandrel and the tool body; and releasing the apparatus upon completion of the relative movement.

BRIEF DESCRIPTION OF THE DRAWINGS

The foregoing and additional objects and advantages of the invention will become more apparent as the following detailed description is read in conjunction with the accompanying drawing wherein like reference characters denote like parts in all views and wherein:

FIGS. 1 and 2 comprise a view, partly in cross section and partly in elevation of a running tool that is constructed in accordance with the invention.

DETAILED DESCRIPTION OF THE PREFERRED EMBODIMENT

Figure 3:
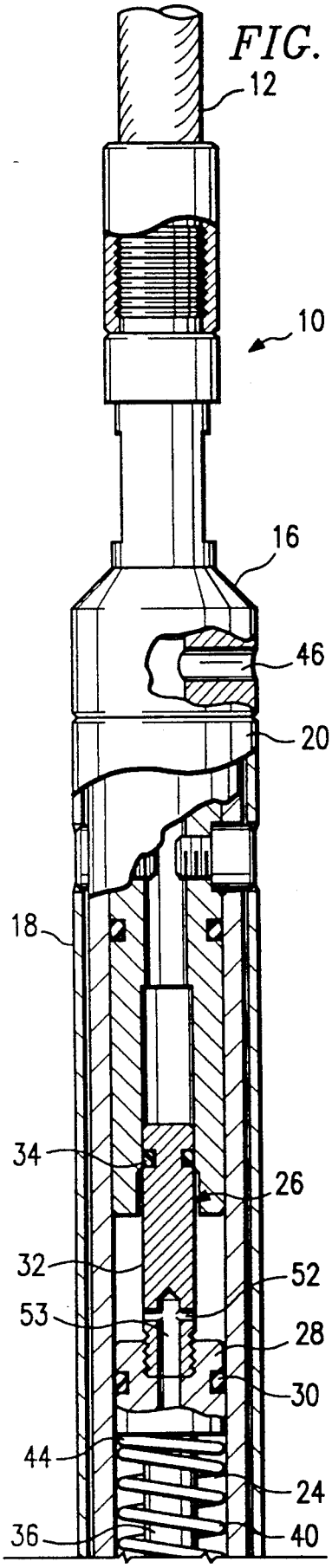
FIGS. 3 and 4 comprise a view similar to FIGS. 1 and 2, but illustrating the running tool in another operating position.

Referring to the drawing and to FIGS. 1 and 2 in particular, shown therein and generally designated by the reference character 10 is a running tool that is constructed in accordance with the invention.

Attached to the upper end of the running tool 10 is a wire line 12 and releasably connected to the lower end of the tool 10 is well apparatus 14 that is to be run into the well bore.

Tool 10 includes a hollow tool body 16 which, although referred to by a single reference character, may consist of several parts due to manufacturing requirements. A sleeve 18 encircles the tool body 16 and is attached to the body 16 at upper end 20 with lower end 22 being open and extending past a lower end of the tool body 16. The hollow body 16 defines a sealed chamber 24 that is located within the body 16.

A mandrel assembly, which is designated by the reference character 26, is slidingly positioned within the body 16 and includes an exterior radially extending flange 28. A seal 30 on the flange 28 is in sliding and sealing engagement with the interior of the body 16 within the chamber 24. The mandrel 26 includes an upper stem portion 32 of reduced diameter which carries a seal ring 34 that is in sliding and sealing engagement with the interior of the body 16. A lower stem portion 36 of the mandrel 26 also carries a seal 38 that is in sliding and sealing engagement with the interior of the body 16. It should be noted that the diameters of the upper and lower stem portions 32 and 36, respectively, are identical so that the cross-sectional area thereof will be identical.

A compression spring 40 encircles the lower stem portion 36 of the mandrel 26 within the chamber 24 and has a lower end 42 engaging the tool body 16 and an upper end 44 engaging the lower side of the flange 28. The spring 40 exerts a constant biasing force upwardly on the mandrel 26 with respect to the tool body 16. Preferably, the spring 40 has a spring rate selected so that it will balance the weight of the apparatus 14 which is being lowered into the well bore.

In order to avoid the effect of hydrostatic pressure on the mandrel 26, the tool body 16 is provided with an upper passageway 46 so that the upper stem portion 32 on the mandrel 26 is exposed to well bore fluids. Similarly, the tool body 16 is provided with a lower passageway 48 so that the lowermost end 50 of the lower stem portion 36 of the mandrel 26 will likewise be exposed to well bore fluids. Accordingly, and since the areas of the lower stem portion 36 and the upper stem portion 32 are identical, the mandrel 26 is balanced with respect to hydrostatic pressure exerted by the fluids in the well bore.

The chamber 24 is filled with a substantially incompressible fluid and preferably one that shows little viscosity change in response to temperature changes in the well bore.

As can be seen in FIG. 1, a metering passageway 52, that may include a removable orifice 53, extends through the flange 28 from an opening 54 in the lower stem portion 32 to openings 56 in the upper stem portion 36. It will be appreciated that for the mandrel 26 to move with respect to the tool body 16, the flange 28 must move through the chamber 24 which is, as just mentioned, filled with a substantially incompressible fluid. Accordingly, the rate of travel of the flange 28 and mandrel 26 through the chamber 24 is governed by the rate of fluid flow through the metering passageway 52. As the mandrel 26 traverses the chamber 24, no fluid is lost from the chamber 24 since the seal 34 closes the chamber 24 at the upper end and the seal 38 closes the chamber 24 at the lower end.

The mandrel 26 carries on its lower end 50 a lock member carrier 60. The lock member carrier 60 is provided with recesses 62 in the lower end thereof for receiving pivotally mounted lock members 64. Only two lock members 64 are illustrated. If desired, three or more lock members 64 could be utilized. The lock members 64 are retained in alignment with windows 66 which extend through a flexible collet member 68. The relationship between the lock member 64 and the windows 66 is maintained by screws which prevent the collet member 68 and lock member carrier 60 from moving relative to each other. The lock members 64, in addition to being pivotally mounted on the lock member carrier 60, are biased by springs 67 relatively outwardly through the windows 66 when the sleeve 18 is moved as will be described. The lower end of the collet member 68 is slotted to provide a plurality of flexible collet fingers 70 which are configured as shown at 72 to retain the well apparatus 14 securely attached to the running tool 10.

It is a desirable feature of the running tool 10 that once the sleeve 18 has been moved upwardly relative to the mandrel 26 that reverse movement of the sleeve 18 does not occur. To ensure that the movement is only in one direction after release of the well apparatus 14, the running tool 10 is provided with a latch mechanism.

The latch mechanism consists of an annular groove 80 formed on the exterior of the lower stem portion 36 of the mandrel 26. As shown in FIG. 2, the recess 80 is located above an internal lock ring 82 which is slidable on the exterior of the lower stem portion 36. The lock ring 82 is retained in its position in the body by an external lock ring or keeper 84. Although the mandrel 26 has been displaced downwardly slightly, an enlarged view of the relationship between the lock ring 82, the stem 36 and the recess 80 are more clearly shown in FIGS. 5 and 6.

OPERATION OF THE PREFERRED EMBODIMENT

FIGS. 1 and 2, taken together, illustrate the condition of the various parts of the tool 10 in running position. As previously described, the well apparatus 14 is attached to the lower end of the tool 10 and is retained thereon by the collet fingers 70 which are held in position by the lower end 22 of the sleeve 18. The flexible collet fingers 70 cannot flex outwardly and release the well apparatus 14.

The apparatus 14 illustrated is a firing head for a perforating gun. It will be understood that any well tool could be run that can be manipulated properly by the running tool 10.

In the position of the various components of the tool in the running position, it will be noted that the lock ring 82 is not engaged with the annular recess 80 in the lower stem portion 36 of the mandrel 26. The lock members 64, are retained in the retracted position due to the sleeve 18 and, thus, cannot interfere with running of the tool 10 and apparatus 14 into the well bore.

After running the tool 10 to the desired location in the well bore, the apparatus 14 is attached to another tool (not shown) located therein or will be positioned in a profile so that the apparatus 14 is locked to the well bore wall or tubing in some manner well known in the art.

After this has occurred, an upward or tensile force is taken on the wire line 12. The force is preferably about 650 pounds in excess of the weight of the apparatus 14. As the force is maintained, the tool body 16 and the sleeve 18 begin to move relatively upwardly with respect to the collet 68 and mandrel 26 to which the collet 68 is attached through the lock member carrier 60. The movement cannot occur instantaneously due to the presence of the substantially incompressible liquid located in the chamber 24.

As the tensile force is continued to be exerted on the body 16, fluid in the chamber 24 is displaced through the metering passageway 52 from the lower side of the flange 28 to the upper side thereof. Preferably, the force must be maintained on the wire line 12 for a minimum of 30 seconds before the body 16 and sleeve 18 have moved upwardly a sufficient distance to release the collet 68 and the lock members 64 from the end 22 of the sleeve 18. The reason for the desirable time delay is that should tight spots be encountered when lowering the tool 10 into the well, an upward strain can be taken to attempt to free the tool 10 and connected well apparatus 14 without effecting release of the tool 10. The operator of the tool can pull upwardly and release the force and the parts are under the biasing influence of the spring 40, so that an additional upward pull can be taken on the tool 10. Such forces can be applied repeatedly so long as the actuation time does not exceed the time for release on a single pull.

Figure 4:
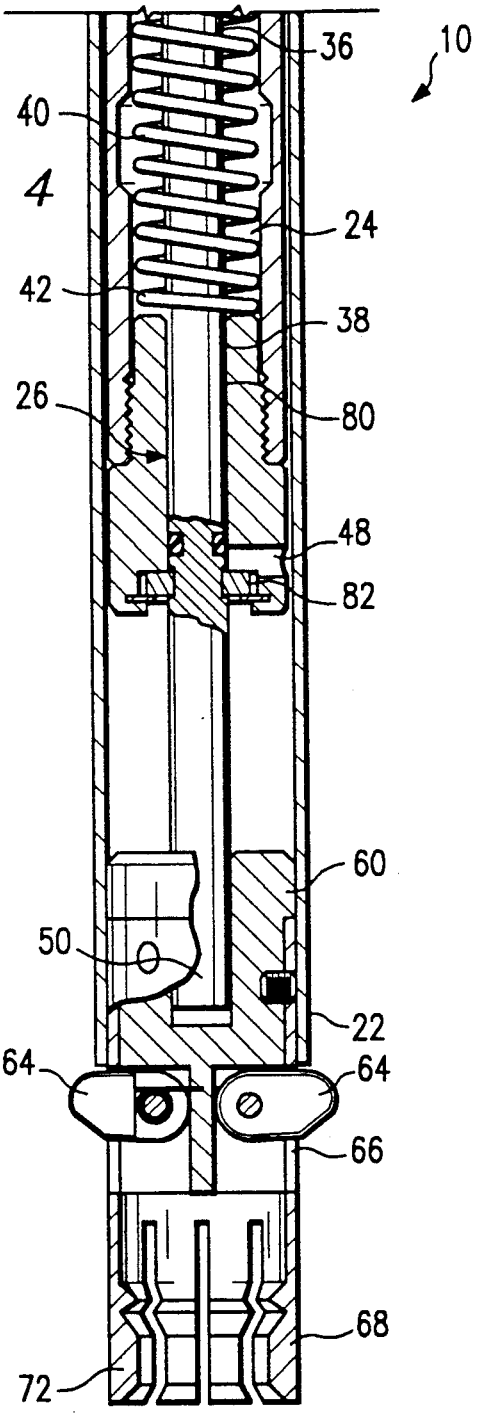
Figure 5:
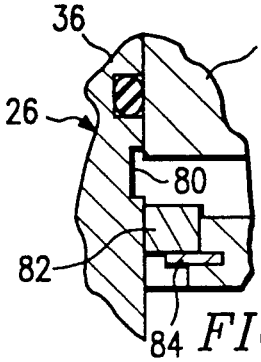
FIG. 5 is an enlarged, fragmentary cross-sectional view of a portion of the running tool to show the mandrel latch in greater detail.
Figure 6:
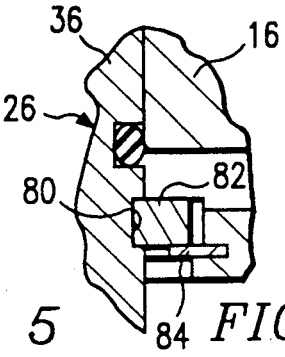
FIG. 6 is an enlarged, fragmentary, cross-sectional view similar to FIG. 5, but showing the mandrel latch in the latched position.

As the body 16 moves upwardly, the internal lock ring 82 approaches the annular recess 80 in the lower stem 36 in the mandrel 26 (See FIG. 5). As soon as the lock ring 82 is over the recess 80, the lock ring 82 moves into the recess 80 locking the mandrel 26 and body 16 together as shown in FIGS. 4 and 6.

With the various parts in this released position, the sleeve 18 cannot move downwardly relative to the mandrel 26 and thus, the lock members 64 are displaced outwardly as illustrated in FIG. 4. As the running tool 16 is pulled upwardly through the well bore, the spring loaded lock members 64 can pivot relatively inwardly through the windows 66 to clear any obstructions that may be encountered. However, should the wire line separate, or for any reason should the running tool 10 be inadvertently separated from the retrieving mechanism, the lock members 64 are extended and will engage any obstruction in the well bore having a diameter less than the projected diameter of the outside of the lock members 64. The lock members 64 cannot pivot upwardly because they engage the lock member carrier 60.

The running tool 10 provides the advantages of not being subject to release by a sudden jolt that may occur as the tool 10 is being run; provides positive retention of the connected well apparatus 14 since the sleeve prevents deflection of the flexible collet fingers; prevents the inadvertent actuation of the tool 10; avoids the necessity for using shear screws to control the movement; and provides a means whereby the tool 10 can be manipulated to get out of tight spots in the well bore. If necessary, a downward force can be exerted on the tool 10, such as by the use of jars (not shown), without danger of releasing the tool 10 from the apparatus 14 since no shear screws are used which could be parted by the downward force.

Having described but a single embodiment of the invention it will be understood that many changes and modifications can be made thereto without departing from the spirit or scope of the invention.

What is claimed is:

1. A running tool for use in locating releasable apparatus in a well bore comprising:

an elongated, hollow tool body;

a fixed length mandrel slidingly disposed in said tool body and movable therein from a running position, when connected to the well apparatus, to a release position when disconnected from the well apparatus;

an outer sleeve encircling said body and having a first end extending past one end of said body;

a resilient collet member carried by said mandrel and disposed within the first end of said sleeve when said mandrel is in said running position and outside said sleeve when said mandrel is in said release position;

a sealed chamber of fixed volume in said body;

a substantially incompressible fluid substantially filling said chamber;

a flange on said mandrel located in said chamber, said flange carrying a seal in sliding and sealing engagement with said body; and a metering passageway in said mandrel providing restricted fluid flow from one side of said seal to the other as said mandrel moves therein, thereby determining the time required to move said mandrel between said positions.

2. The tool of claim 1 wherein:

said mandrel has first and second ends of substantially identical cross-sectional area; and said body and sleeve have first and second passageways extending therethrough exposing respective ends of said mandrel to the hydrostatic head of well bore liquid, whereby said mandrel is hydrostatically balanced.

3. The tool of claim 2 and also including:

a seal encircling the first end of said mandrel in sliding and sealing engagement with said body; and a seal encircling the second end of said mandrel in sliding and sealing engagement with said body, thereby preventing mixing of well bore liquid with the fluid in said chamber.

4. The tool of claim 1 and also including a compression spring engaging said mandrel and said body for biasing said mandrel in a direction to oppose the weight of the apparatus being located in the well bore.

5. The tool of claim 3 and also including a compression spring engaging said mandrel and said body for biasing said mandrel in a direction to oppose the weight of the apparatus being located in the well bore.

6. The tool of claim 5 wherein said spring is located in said chamber and has one end engaging said flange and the other end engaging said body.

7. The tool of claim 1 and also including latch means for holding said mandrel in said release position.

8. The tool of claim 3 and also including latch means for holding said mandrel in said release position.

9. The tool of claim 7 wherein said latch means includes:

a recess in said mandrel; and a detent carried by said body for engaging said mandrel in said recess when said mandrel is in the release position.

10. The tool of claim 9 wherein:

said recess is a groove encircling said mandrel; and said detent comprises an internal lock ring.

11. The tool of claim 8 wherein said latch means includes:

a recess in said mandrel; and a detent carried by said body for engaging said mandrel in said recess when said mandrel is in the release position.

12. The tool of claim 11 wherein:

said recess is a groove encircling said mandrel; and said detent comprises an internal lock ring.

13. The tool of claim 1 and also including:

a stop member carrier connected to the second end of said mandrel;

a plurality of one-way stop members pivotally mounted on the stop member carrier and located within said sleeve and collet member in the running position of said mandrel;

a slot extending through said collet member for each said stop member;

means on each said stop member for resiliently pivoting said stop members so that an end on each stop member projects through a respective slot and outside of said tool, said stop members engaging said stop member carrier to stop the pivotal movement outwardly, whereby said tool cannot move downwardly in said well through diameters therein less than the diameter defined by said stop members when extended, but can move upwardly through such diameters by pivoting the stop members toward said tool.

14. The tool of claim 7 and also including:

a stop member carrier connected to the second end of said mandrel;

a plurality of one-way stop members pivotally mounted on the stop member carrier and located within said sleeve and collet member in the running position of said mandrel;

a slot extending through said collet member for each said stop member;

means on each said stop member for resiliently pivoting said stop members so that an end on each stop member projects through a respective slot and outside of said tool, said stop members engaging said stop member carrier to stop the pivotal movement outwardly, whereby said tool cannot move downwardly in said well through diameters therein less than the diameter defined by said stop members when extended, but can move upwardly through such diameters by pivoting the stop members toward said tool.

15. The tool of claim 8 and also including:

a stop member carrier connected to the second end of said mandrel;

a plurality of one-way stop members pivotally mounted on the stop member carrier and located within said sleeve and collet member in the running position of said mandrel;

a slot extending through said collet member for each said stop member;

means on each said stop member for resiliently pivoting said stop members so that an end on each stop member projects through a respective slot and outside of said tool, said stop members engaging said stop member carrier to stop the pivotal movement outwardly, whereby said tool cannot move downwardly in said well through diameters therein less than the diameter defined by said stop members when extended, but can move upwardly through such diameters by pivoting the stop members toward said tool.

16. The tool of claim 9 and also including:

a stop member carrier connected to the second end of said mandrel;

a plurality of one-way stop members pivotally mounted on the stop member carrier and located within said sleeve and collet member in the running position of said mandrel;

a slot extending through said collet member for each said stop member;

means on each said stop member for resiliently pivoting said stop members so that an end on each stop member projects through a respective slot and outside of said tool, said stop members engaging said stop member carrier to stop the pivotal movement outwardly, whereby said tool cannot move downwardly in said well through diameters therein less than the diameter defined by said stop members when extended, but can move upwardly through such diameters by pivoting the stop members toward said tool.

17. The tool of claim 10 and also including:

a stop member carrier connected to the second end of said mandrel;

a plurality of one-way stop members pivotally mounted on the stop member carrier and located within said sleeve and collet member in the running position of said mandrel;

a slot extending through said collet member for each said stop member;

means on each said stop member for resiliently pivoting said stop members so that an end on each stop member projects through a respective slot and outside of said tool, said stop members engaging said stop member carrier to stop the pivotal movement outwardly, whereby said tool cannot move downwardly in said well through diameters therein less than the diameter defined by said stop members when extended, but can move upwardly through such diameters by pivoting the stop members toward said tool.

18. A method for positioning apparatus in a well bore comprising the steps of:

extending a running tool with the apparatus releasably connected thereto to the desired location in the well bore;

compensating for the weight of the tool being lowered;

exerting a substantially constant tensile force on the tool for a predetermined time of not less than thirty seconds until the apparatus releases from the tool; and withdrawing the disconnected running tool.

19. A method for positioning apparatus in a well bore comprising the steps of:

extending a running tool with the apparatus releasably connected thereto to the desired location in a well bore;

exerting a substantially constant tensile force on the tool for causing relative movement between a mandrel and tool body to release the apparatus;

delaying the relative movement between the mandrel and tool body; and releasing the apparatus upon completion of said relative movement, thereby positioning the apparatus where desired in the well bore.

20. A method for positioning apparatus in a well bore comprising the steps of:

extending a running tool with the apparatus releasably connected thereto into the well bore toward the desired location in the well bore with the running tool in a running position;

exerting a tensile force on said running tool for less than thirty seconds in the event that the apparatus cannot be moved to the desired location, moving the running tool toward a release position;

releasing the tensile force;

restoring said running tool to the running position;

moving said running tool and apparatus to the desired location in the well bore;

exerting a substantially constant tensile force on the tool for a predetermined time of not less than thirty seconds until the apparatus releases from the tool; and withdrawing the disconnected running tool.

21. The method of claim 20 including, until said running tool and apparatus can be moved, repeating the steps of:

exerting a tensile force on said running tool for less than thirty seconds;

releasing the tensile force; and restoring said running tool to the running position.

22. A method for positioning apparatus in a well bore comprising the steps of:

extending a running tool with the apparatus releasably connected thereto into the well bore toward the desired location in the well bore with the running tool in a running position;

exerting a tensile force on said running tool for a period of time less than required to release said apparatus in the event that said running tool and apparatus cannot be moved to said desired location;

releasing the tensile force;

restoring said running tool to the running positions moving said running tool and apparatus to said desired location;

exerting a substantially constant tensile force on the tool for causing relative movement between a mandrel and tool body to release the apparatus;

delaying the relative movement between the mandrel and tool body; and releasing the apparatus upon completion of said relative movement, thereby positioning the apparatus where desired in the well bore.

23. The method of claim 22 including, until said running tool and apparatus can be moved, repeating the steps of:

exerting the tensile force on said running tool for a period of time less than required to release said apparatus;

releasing the tensile force; and restoring said running tool to the running position.

* * * * *